US010034521B1

(12) United States Patent
Miller

(10) Patent No.: US 10,034,521 B1
(45) Date of Patent: Jul. 31, 2018

(54) ZIPPER PULL TAB APPARATUS

(71) Applicant: Austin Jeffrey Miller, Phoenix, AZ (US)

(72) Inventor: Austin Jeffrey Miller, Phoenix, AZ (US)

( * ) Notice: Subject to any disclaimer, the term of this patent is extended or adjusted under 35 U.S.C. 154(b) by 0 days.

(21) Appl. No.: 15/669,940

(22) Filed: Aug. 6, 2017

(51) Int. Cl.
*A44B 19/30* (2006.01)
*A44B 19/26* (2006.01)

(52) U.S. Cl.
CPC ..... *A44B 19/301* (2013.01); *A44B 19/262* (2013.01); *A44D 2203/00* (2013.01)

(58) Field of Classification Search
CPC ..... A44D 2203/00; A44B 19/301; A44B 19/262; Y10T 24/2598
See application file for complete search history.

(56) References Cited

U.S. PATENT DOCUMENTS

| | | | | |
|---|---|---|---|---|
| 3,325,869 | A | 6/1967 | Younger | |
| 7,204,001 | B2 * | 4/2007 | Lin | A44B 19/262 24/429 |
| 8,453,301 | B1 | 6/2013 | McCoy | |
| 2012/0246890 | A1 * | 10/2012 | Hernandez | A44B 19/301 24/436 |

* cited by examiner

*Primary Examiner* — Robert Sandy

(57) ABSTRACT

A magnetic zipper pull tab apparatus includes a zipper pull tab and zipper body that contain corresponding magnetic elements. The zipper pull tab is shaped and functions much like a traditional zipper tab, and the zipper functions like a traditional zipper. The magnetic elements allow the zipper tab to magnetically secure to the zipper body when the zipper is in a closed position. The zipper tab and zipper body contain magnetic elements by way of having magnets affixed to or located inside of them, or are themselves made from magnetic materials.

6 Claims, 4 Drawing Sheets

ZIPPER PULL TAB APPARATUS

BACKGROUND OF INVENTION

A complete zipper system usually includes a zipper body with two halves, called stringers, which have interlocking links that are zipped and unzipped by a slider. The slider has attached to it a pull tab, which the user applies force to in order to make the slider slide along the stringers. Some pull tabs are rigid and lay flat along the interlocked stringers by virtue of locking mechanisms integrated in the slider. However, many pull tabs are flexible or otherwise non-rigid, or are not connected to sliders with locking mechanisms. For such pull tab assemblies, the pull tab may flop around, dangle, or otherwise move in an unintended or undesired way. Thus, a simple, inexpensive way to secure such zipper tabs to the body of the zipper is necessary.

Some devices in the prior art are directed towards magnetic zipper tabs that secure to areas away from the zipper itself. For example, U.S. Pat. No. 3,325,869 is directed towards a magnetic zipper tab that secures to magnetic connections displaced above the zipper. This device requires two magnetic connections and a t-shaped tab. Such an apparatus is inferior to the present invention because it necessitates that extra space above the zipper end be used for the securing the zipper tab. Additionally, the apparatus is directed primarily to secure the entire zipper slider, giving it a large size that is too bulky for many applications, such as garments. The present device is primarily directed to secure the pull tab alone, though securing the slider may be another object of invention. Other devices in the prior art use magnets that are affixed to only a portion of the pull tab, which secure to corresponding magnets placed away from the zipper body. Again, the location of the stationary magnet necessitates a dedicated space to the side of the zipper, making it inappropriate for many applications, and incompatible with zippers that utilize a rigid pull tab. Also, because only a portion of the tab contains a magnet, the tab is not completely secured to the corresponding magnet.

The present invention solves the problems associated with the prior art because it provides a zipper pull tab that magnetically secures directly to the body of the zipper. Because it is secured directly to the body of the zipper, the pull tab stays in line with the zipper stringers and reduces the space taken up by the entirety of the zipper apparatus. Another advantage of the present invention is that the receiving magnetic portion, being located along the zipper body, provides a more reliable target for a user when placing the pull tab in the secure position. Prior art that utilizes magnets located away from the zipper body can be difficult for a user to locate as the user attempts to place the pull tab onto the corresponding magnet. Also, some zipper applications utilize coverings such as fabric that overlap the zipper, known as "lapped zippers." The prior art could not be utilized with lapped zippers, as they are too bulky and orient the pull tab such that it would not be covered by the overlapping fabric. The present invention allows a magnetically secured zipper to be used with a lapped zipper because it allows the pull tab to be lined up directly with the zipper, thus being covered by the overlapping fabric.

SUMMARY OF THE INVENTION

In various representative aspects, the present invention includes a magnetic zipper pull tab apparatus which includes a pull tab with magnetic elements and a zipper body with magnetic elements. The zipper apparatus is designed for use in most places where a conventional zipper might be used. The zipper apparatus is designed such that the pull tab is able to magnetically affix to the zipper body. Magnetic elements are contained in the pull tab and along the zipper stringers such that when the stringers are interlocked, the pull tab may be secured to the zipper body by way of magnetic connection between the corresponding magnetic elements. The unique design of the zipper apparatus allows a user to prevent the pull tab from moving in an undesired way.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements throughout the figures.

DESCRIPTION OF NUMERALS USED IN THE FIGURES

1. Zipper body
2. Teeth
3. Tape
4. Slider
5. Pull tab magnetic portion
6. Zipper body magnetic portion
7. Rivet

DETAILED DESCRIPTION OF EXEMPLARY EMBODIMENTS

Opening

The present invention describes a magnetic zipper pull tab apparatus (the "apparatus") which provides a means for limiting undesired zipper pull tab movement and undesired zipper opening.

Structure

Zipper Overview

The apparatus is meant to be used with conventional zippers, which most commonly are made up of two stringers, a slider, a pull tab, and end portions. Each stringer is comprised of a tape portion and a series of teeth. The tape portion functions as the point of connection between the zipper and the object it is affixed to, for example, a garment or piece of luggage. The teeth are affixed to the tape and interlock when the zipper is in a closed or engaged position. The slider is affixed to the stringers and slides along them to interlock the teeth. The pull tab is affixed to the slider such that a user can move the slider by applying force to the pull tab. Each end of the zipper contains a stop portion or a pin portion, depending on the type of zipper.

Magnetic Components

The apparatus comprises two magnetic components: the pull tab magnet portion and the zipper body magnet portion.

Pull Tab Magnetic Portion

Figure 1:
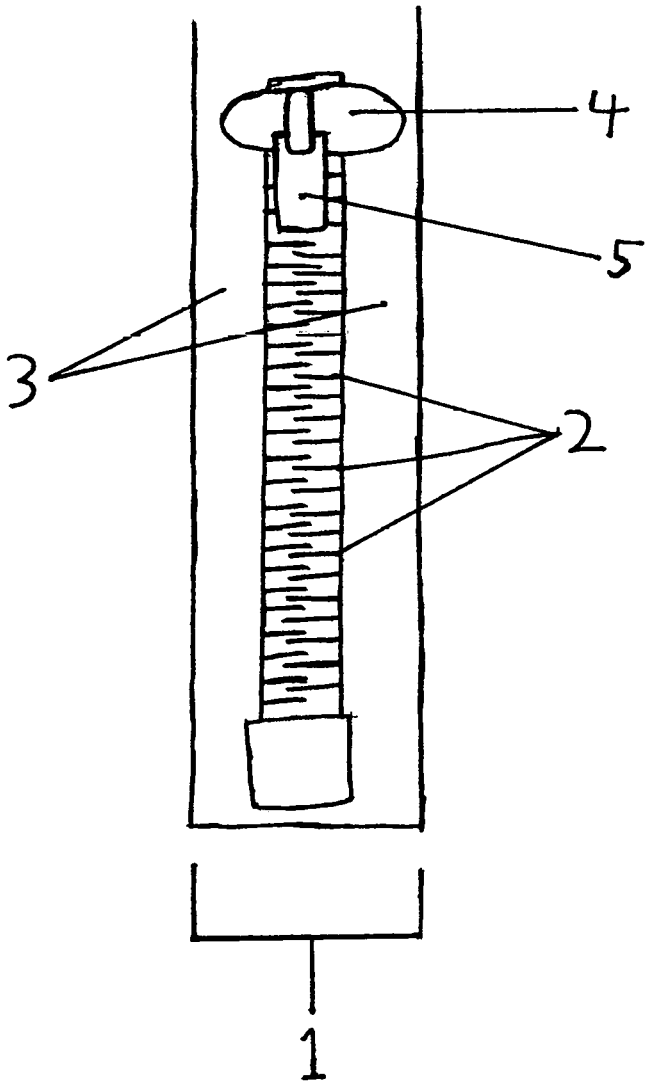
FIG. 1 representatively illustrates a front view of the apparatus, where the zipper is in a closed position, and the pull tab is magnetically engaged with the zipper body.
Figure 2:
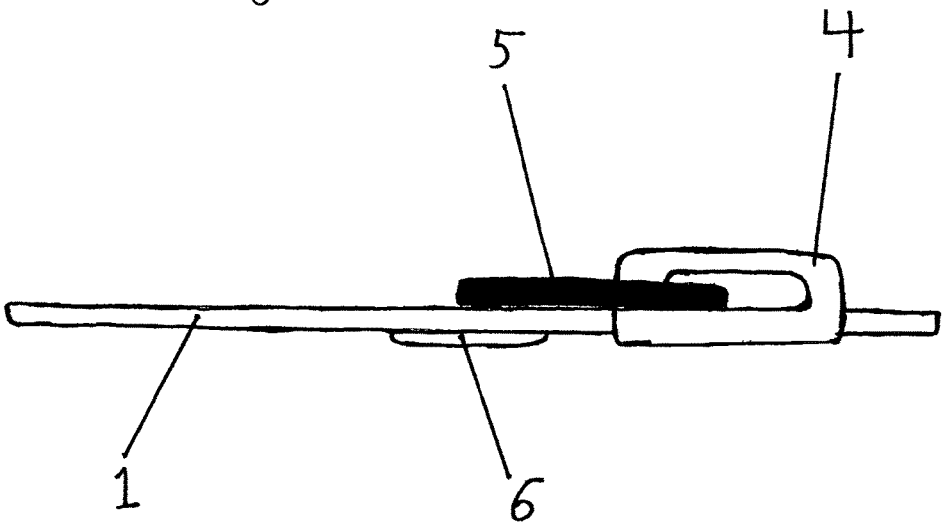
FIG. 2 representatively illustrates a side view of the apparatus, where the zipper is in a closed position, and the pull tab is magnetically engaged with the zipper body.

In the preferred embodiment, the pull tab magnetic portion (5) is fabricated from a magnetic material, and is shaped like a conventional, rigid zipper pull tab. It is connected to the zipper slider (4) and functions as a conventional zipper pull tab. In the preferred embodiment, the pull tab magnetic portion is coated with a synthetic material to protect the pull tab and improve its aesthetic look. Other embodiments may utilize rigid, hollow pull tabs that encompass a magnetic material, or non-rigid pull tabs that utilize magnets affixed thereto, such as a pull tab fabricated from leather or fabric material. Referring now to FIG. 1, a front view of the pull tab, as utilized in a zipper system according to the preferred embodiment of the present invention, is disclosed. In the preferred embodiment, the pull tab magnetic portion is shaped like a conventional rigid pull tab. When the pull tab magnetic portion is displaced against the zipper body (1), it magnetically engages the zipper body magnetic portion (2).

Zipper Body Magnetic Portion

In the preferred embodiment, the zipper body magnetic portion (6) is a piece of magnetic material that is located on the underside of the zipper such that the zipper teeth are between it and the pull tab magnetic portion. In the preferred embodiment, it is coated in a synthetic material to protect it and the zipper teeth. In other embodiments, the zipper body magnetic portion may not be coated in a synthetic material, or may be constructed as a hollow piece that encompasses a magnetic material. In other embodiments, the zipper body magnetic portion may be located above the zipper teeth such that the pull tab magnetic portion is in direct contact with it when in an engaged position.

In the preferred embodiment, the zipper body magnetic portion is affixed to the zipper tape (3) on either side of the zipper teeth. In the preferred embodiment, the zipper body magnetic portion is affixed to the tape via rivets (7). Other embodiments may include zipper body magnetic portions that are affixed to the tape through other means, such as glue adhesive, staples, or other suitable fastening means.

Figure 3:
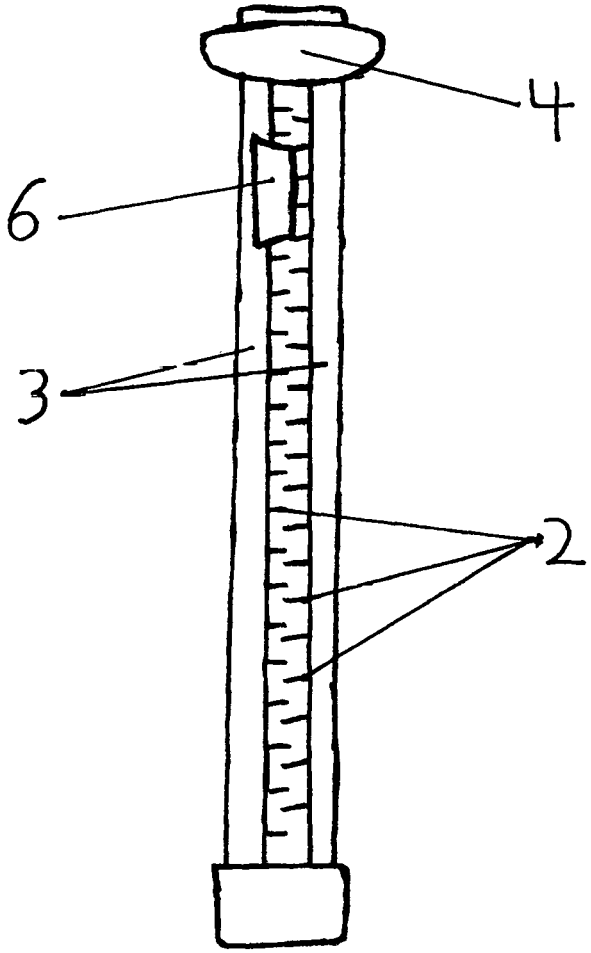
FIG. 3 representatively illustrates a rear view of the apparatus according to a preferred embodiment of the present invention, where the zipper is in a closed position, and the zipper body magnet portion is affixed to the zipper body.
Figure 4:
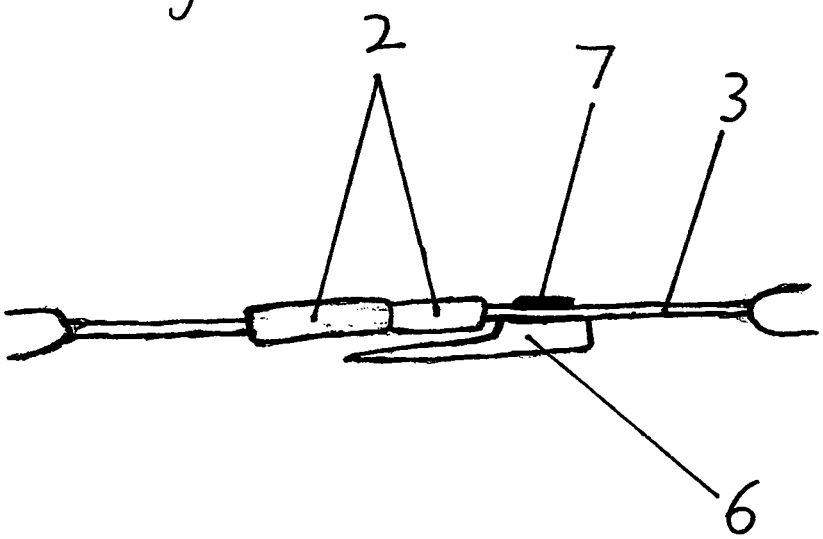
FIG. 4 representatively illustrates a side view of the apparatus according to a preferred embodiment of the present invention, where the zipper body magnetic portion has an angled shape.

The zipper body magnetic portion extends laterally from its attachment point on the tape, such that it is positioned directly adjacent to the zipper teeth. Referring now to FIG. 3, a rear view of the zipper body with the zipper body magnetic portion affixed thereto, according to a preferred embodiment of the present invention, is disclosed. The zipper body magnetic portion is positioned on the zipper tape so as to line up with the pull tab magnetic portion when the zipper is in a closed position and the pull tab magnetic portion is displaced along the zipper body.

In the preferred embodiment, the zipper body magnetic portion has an elongated shape such that it may provide a long enough attachment point for the pull tab magnetic portion. In the preferred embodiment, the zipper body magnetic portion narrows as it extends toward the zipper teeth such that the zipper slider does not catch on it. Other embodiments may utilize zipper body magnetic portions that are round in shape, or that do not narrow at the end, or are any other suitable shape.

Closing

In the foregoing specification, the invention has been described with reference to specific exemplary and preferred embodiments. Various modifications and alterations may be made, however, without departing from the scope of the present invention as set forth in the claims. The specification and figures are illustrative, not restrictive, and modifications are intended to be included within the scope of the present invention. Accordingly, the scope of the invention should be determined by the claims and their legal equivalents rather than by only the embodiments described in the foregoing specification.

For example, the components recited in the claims may be assembled or otherwise operationally configured in a variety of ways and are accordingly not limited to the specific configuration recited in the claims.

Benefits, advantages, and solutions to problems have been described above with regard to specific embodiments. Any benefit, advantage, solution, or any element that may cause any particular benefit, advantage, or solution to occur or to become more pronounced are not to be construed as critical, required, or essential features or components of any or all the claims.

What is claimed is:

1. A magnetic zipper pull tab apparatus of the type used with a conventional zipper, comprising:

(a) a pull tab magnetic portion and a zipper body magnetic portion;

(b) said pull tab magnetic portion being comprised of a first magnetic material;

(c) said pull tab magnetic portion being affixed to a slider of said zipper;

(d) said zipper body magnetic portion being affixed to one side of a tape of said zipper and extending towards teeth of said zipper;

(e) said zipper body magnetic portion being comprised of a second magnetic material.

2. A magnetic zipper pull tab apparatus according to claim 1, wherein the first magnetic material is shaped like a conventional zipper pull tab and is coated in a protective material.

3. A magnetic zipper pull tab apparatus according to claim 1, wherein the first magnetic material comprises a magnet affixed to a conventional zipper pull tab.

4. A magnetic zipper pull tab apparatus according to claim 1, wherein the first magnetic material comprises a magnet contained within a conventional zipper pull tab.

5. A magnetic zipper pull tab apparatus according to claim 1, wherein the zipper body magnetic portion is affixed to said tape with one or more rivets.

6. A magnetic zipper pull tab apparatus according to claim 1, wherein the zipper body magnetic portion is affixed to said tape with glue adhesive.

* * * * *